US011864634B1

(12) United States Patent
Chen

(10) Patent No.: US 11,864,634 B1
(45) Date of Patent: Jan. 9, 2024

(54) QUICK RELEASE BUCKLE

(71) Applicant: Sheng Chen, Ningbo (CN)

(72) Inventor: Sheng Chen, Ningbo (CN)

( * ) Notice: Subject to any disclaimer, the term of this patent is extended or adjusted under 35 U.S.C. 154(b) by 0 days.

(21) Appl. No.: 18/202,982

(22) Filed: May 29, 2023

(30) Foreign Application Priority Data

Jun. 21, 2022 (CN) ..... 202221559300.X

(51) Int. Cl.
*A44B 11/25* (2006.01)

(52) U.S. Cl.
CPC ..... *A44B 11/25* (2013.01); *Y10T 24/45194* (2015.01); *Y10T 24/45529* (2015.01)

(58) Field of Classification Search
CPC ..... A44B 11/25; A44B 11/2507; A44B 11/26; A44B 11/2592; A44B 11/266; A44B 11/125; Y10T 24/45194; Y10T 24/45241; Y10T 24/45225; Y10T 24/4522; Y10T 24/45215; Y10T 24/45188; Y10T 24/45152; Y10T 24/45; Y10T 24/45529
See application file for complete search history.

(56) References Cited

U.S. PATENT DOCUMENTS

| | | | | |
|---|---|---|---|---|
| 2,870,511 | A * | 1/1959 | Sand | A44C 5/14 24/265 B |
| 4,935,996 | A * | 6/1990 | Ferrara | A44B 11/2596 24/587.11 |
| 10,051,984 | B2 | 8/2018 | Buerck et al. | |
| 10,595,594 | B2 | 3/2020 | Masserini | |
| 2011/0113601 | A1* | 5/2011 | Saint | A44B 11/25 24/595.1 |
| 2015/0305449 | A1* | 10/2015 | Kränzlein | A44B 11/25 2/322 |
| 2021/0093052 | A1* | 4/2021 | Wang | A41F 9/00 |

* cited by examiner

*Primary Examiner* — Robert Sandy
*Assistant Examiner* — Michael S Lee
(74) *Attorney, Agent, or Firm* — Bayramoglu Law Offices LLC

(57) ABSTRACT

A quick release buckle includes a first connecting member, a second connecting member, and a locking member, where the first connecting member is provided with a first chamber, and the second connecting member is provided with a second chamber; the locking member is provided with a first locking part and a second locking part connected to each other; the first locking part is located inside the first chamber, and is connected to the first connecting member through a reset mechanism; and the second locking part is detachably connected to the second chamber.

18 Claims, 6 Drawing Sheets

QUICK RELEASE BUCKLE

CROSS REFERENCE TO THE RELATED APPLICATIONS

This application is based upon and claims priority to Chinese Patent Application No. 202221559300.X, filed on Jun. 21, 2022, the entire contents of which are incorporated herein by reference.

TECHNICAL FIELD

The present disclosure relates to a quick release buckle for connecting a flexible fabric or a similar item.

BACKGROUND

Detachable connection buckles are often found in clothing or clothing accessories. The connection buckle typically includes two parts that are detachably connected to each other. The two parts are located on the clothing or clothing accessory that needs to be connected, for example, the connection strap of a bag, or clothing opening, etc. In the field of outdoor equipment, detachable connection buckles are commonly used in the straps of backpacks or the sternum straps, hip belts, and other parts of special vests to strengthen the connection. They are especially used in situations where emergency locking and unlocking of equipment is required, including but not limited to rescue sites and other potentially high-risk situations that require quick response. The quick release buckle requires a stable connection mechanism and an ability to quickly and accurately release the locked state in emergency situations.

U.S. patent Ser. No. 10/595,594B2 provides a quick release buckle. The quick release buckle achieves locking and unlocking functions by pressing a central drive key and enabling a corresponding sliding movement, but it requires applying two different forces in mutually perpendicular directions to achieve the unlocking function. U.S. patent Ser. No. 10/051,984B2 provides another quick release buckle, which can be unlocked by pressing. The pressing method is an improved unlocking method, but the unlocked part needs to move for a long distance to detach from the locked part, resulting in low unlocking efficiency.

SUMMARY

In order to solve the aforementioned technical problems in the prior art, the present disclosure provides a quick release buckle with a stable structure and an ability to quickly and accurately release a locked state in an emergency situation.

To solve the technical problems, the present disclosure adopts the following technical solution.

The quick release buckle includes a first connecting member, a second connecting member, and a locking member, where the first connecting member is provided with a first chamber, and the second connecting member is provided with a second chamber; the locking member is provided with a first locking part and a second locking part connected to each other; the first locking part is located inside the first chamber, and is connected to the first connecting member through a reset mechanism; and the second locking part is detachably connected to the second chamber.

Further, the second locking part is provided with a bump; the second chamber is provided with a first opening and a second opening that are located in an axial direction and are communicated with each other; the bump enters the second chamber through the first opening in a direction perpendicular to the axial direction, and is unable to be detached from the second chamber through the second opening.

Further, the first opening and the second opening are spaced in sequence.

Further, the second locking part is provided with a main body fixedly connected to the bump; the main body of the second locking part enters the second chamber in the direction perpendicular to the axial direction, and is movable, together with the bump, inside the second chamber in the axial direction.

Further, the main body of the second locking part is fixedly connected to the first locking part.

Further, a side of the first chamber is provided with a gap; and the gap allows the main body of the second locking part to pass through, but does not allow the first locking part to pass through.

Further, one end of the second locking part is provided with a mechanism for unlocking by pulling or pushing by a user.

Further, an unlocking limit mechanism is provided between the locking member and the first connecting member.

Further, the first locking part is provided with a track axially extended; and the reset mechanism is axially connected to the track and the first connecting member.

Further, the reset mechanism is a compression spring; the compression spring includes a first end abutted against one end of the track and a second end abutted against an inner part of the first connecting member; and the compression spring remains compressed throughout an unlocking process.

Further, the reset mechanism is a tension spring; the tension spring includes a first end fixedly connected to one end of the track and a second end fixedly connected to an inner part of the first connecting member; and the tension spring remains extended throughout an unlocking process.

Further, the first connecting member is provided with slots; the slots are communicated with the first chamber, and are axially extended; a driving part is connected to the first locking part through the slots; and the slots define a movement range of the driving part.

Further, the driving part includes a fixed part, a driving handle connected to the fixed part, and a positioning part fixing the fixed part to the first locking part.

Further, the first locking part is provided with a hole running through the first locking part; and the positioning part, at one end of the hole, fixes the fixed part to the other end of the hole.

Further, the first locking part is provided with a first surface; the first chamber is provided with an inner surface; the first surface and the inner surface define a narrow gap; and a highest point of a head of the positioning part is located within the gap.

Further, there are two slots symmetrically arranged at two sides of the first connecting member; and the hole communicates the two slots.

Further, the first locking part is provided with a fixed area and a movable area movably connected to each other; the fixed area is fixedly or detachably connected to the first connecting member; and the movable area is fixedly connected to the second locking part and the driving part.

Further, the second connecting member and the first connecting member are connected to each other in a matched manner through an axial limit structure.

Further, the axial limit structure is located at two ends of each of the second connecting member and the first connecting member.

Further, the axial limit structure includes a step and a notch that are coincident in shape.

Compared with the prior art, the present disclosure has the following advantages. In the present disclosure, the locking member only needs to move for a small distance relative to the first connecting member to achieve locking and unlocking, especially in emergency situations, which greatly improves the efficiency of locking and unlocking and buys more time for action. The present disclosure provides multiple driving methods for unlocking, adapting to different usage habits. When a certain driving method fails, other driving methods can be used, avoiding the problem that the quick release buckle is unusable due to the failure of a single driving method. The present disclosure provides multiple symmetrical designs, and can achieve locking and unlocking without distinguishing the front and back sides, even in emergency situations. The present disclosure allows for rapid shortening of the length of a strap by twisting the first connecting part or the second connecting part multiple times without affecting the locking effect.

REFERENCE NUMERALS

Figure 1:
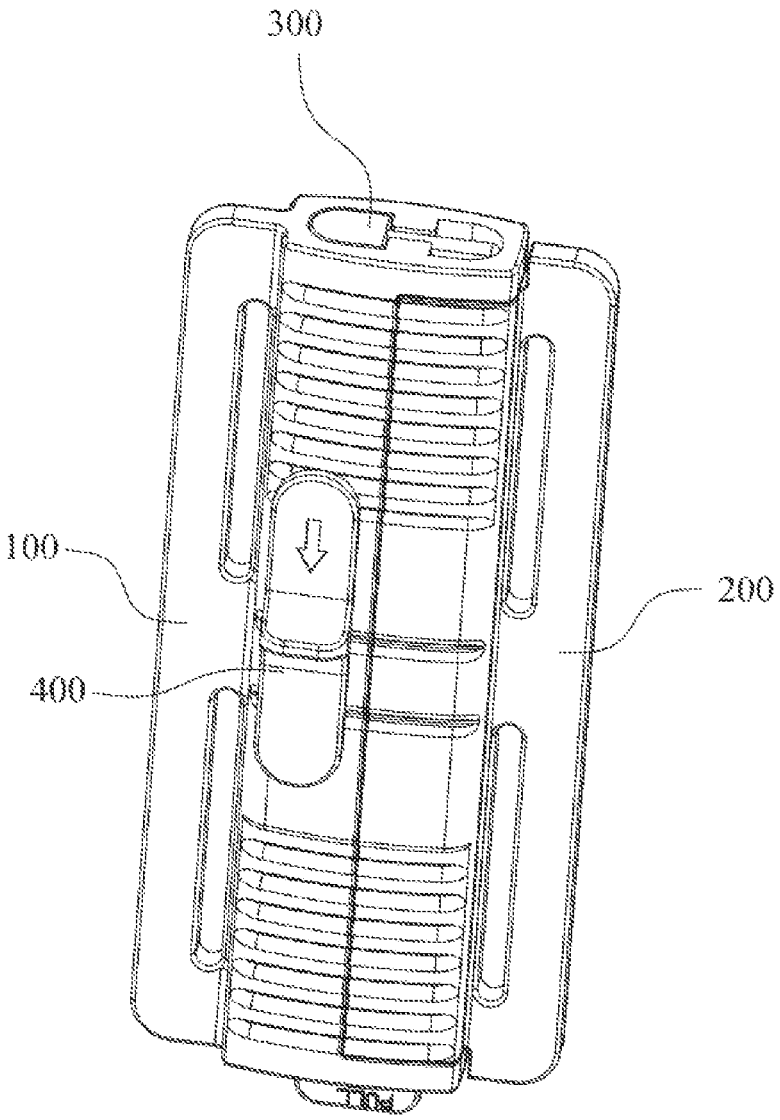
FIG. 1 is an overall structural diagram of a quick release buckle according to the present disclosure.
Figure 2:
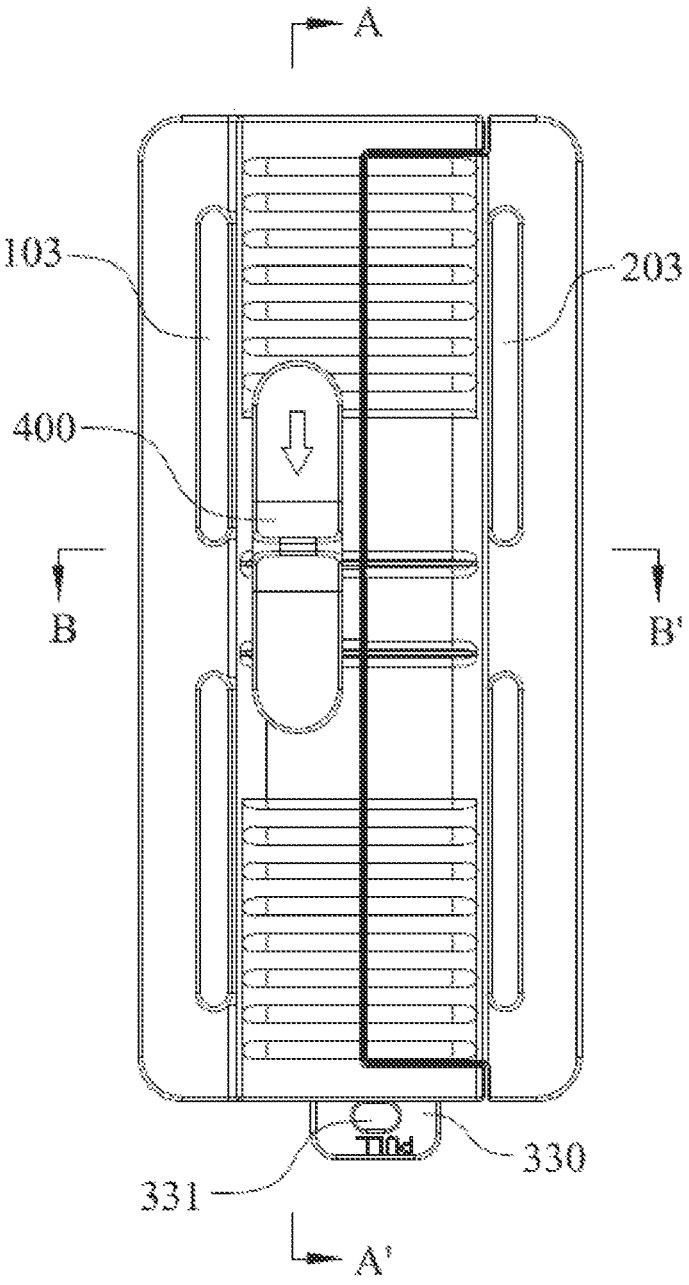
FIG. 2 is a front view of the quick release buckle shown in FIG. 1.
Figure 3:
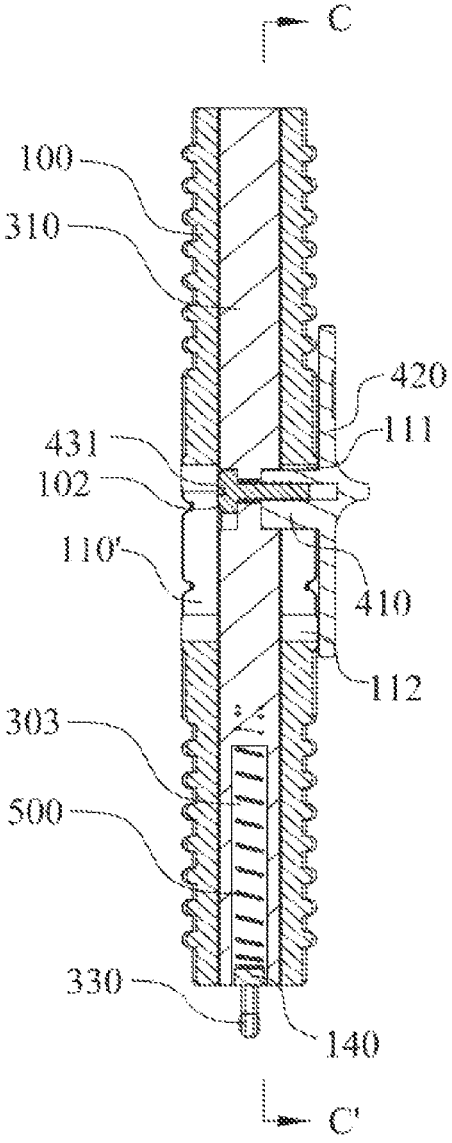
FIG. 3 is a section view taken along line A-A' shown in FIG. 2.
Figure 4:
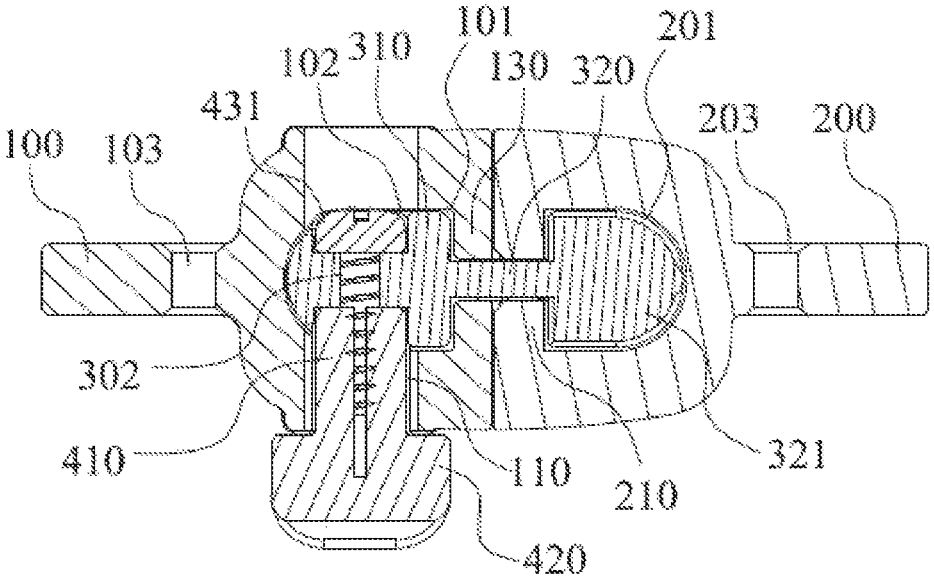
FIG. 4 is a section view taken along line B-B' shown in FIG. 2.

100. first connecting member; 110/110'. slot; 111. head end of slot; 112. tail end of slot; 120. first step; 121. second step; 130. protruding edge; 140. blocking part; 101. first chamber; 102. inner surface of first chamber; 103. first connecting position; 104. head end of first chamber; 105. tail end of first chamber; and 106. gap;

200. second connecting member; 210. edge; 220. end of second connecting member; 221. notch; 201. second chamber; 202. first opening; 203. second connecting position; and 204. second opening;

300. locking member; 310. first locking part; 320. second locking part; 321. bump; 330. extension part; 331. mounting hole; 301. first surface; 302. hole; and 303. track;

400. driving part; 410. fixed part; 420. driving handle; 430. screw; and 431. head of screw; and

500. compression spring; 510. first end of compression spring; and 520. second end of compression spring.

DETAILED DESCRIPTION OF THE EMBODIMENTS

The present disclosure is described in further detail below with reference to the drawings and embodiments.

Referring to FIGS. 1 to 6, the present disclosure provides a quick release buckle. The quick release buckle includes first connecting member 100 and second connecting member 200. The first connecting member 100 and the second connecting member 200 are detachably connected together. The first connecting member 100 is provided with first chamber 101, and the second connecting member 200 is provided with second chamber 201. The quick release buckle further includes locking member 300. The locking member is provided with first locking part 310 and second locking part 320 connected to each other. The first locking part 310 is located inside the first chamber 101, and the second locking part 320 is detachably connected to the second chamber 201.

The first connecting member 100 is provided with the first chamber 101. The locking member 300 is provided with the first locking part 310. The first locking part 310 is movable back and forth axially inside the first chamber 101, and the first chamber 101 is communicated with an outside of the first connecting member 100.

In the present disclosure, "axially" refers to an extension direction of the first chamber 101 and the second chamber 201. The first chamber 101 and the second chamber 201 are parallel to each other, and the first chamber 101 and the second chamber 201 are communicated with each other to form a chamber.

In an embodiment, the first connecting member 100 is provided with slot 110 communicated with the first chamber 101. The slot 110 extends axially, and the slot 110 is provided with head end 111 and tail end 112. Driving part 400 is connected to the first locking part 310 through the slot 110. The connection can be detachable or fixed. In an embodiment, the driving part 400 includes fixed part 410, driving handle 420 connected to the fixed part 410, and positioning part fixing the fixed part 410 to the first locking part 310. The positioning part can be screw 430, a rivet, a pin, a wedge, or any other component that can fix the fixed part 410 to the first locking part 310. In an embodiment, a part of the first locking part 310 corresponding to the slot 110 is provided with hole 302 that runs through the first locking part 310 to accommodate the fixed part 410 and the screw 430. The screw 430, at one end of the hole 302, fixes the fixed part 410 to the other end of the hole 302. In an embodiment, the first locking part 310 is provided with first surface 301. Atop of head 431 of the screw is basically flush with the first surface 301. The first chamber 101 is provided with inner surface 102. The inner surface 102 is opposite to the first surface 301, and there is a narrow gap between the inner surface and the first surface. A highest point of the head 431 of the screw is located within the gap. The inner surface 102 is not in contact or in contact with the head 431 of the screw, but there is no compression deformation. When the first locking part 310 is moved back and forth inside the first chamber 101, there is no friction between the head 431 of the screw and the inner surface 102. In another embodiment, the inner surface 102 is in contact with the head 431 of the screw. When the first locking part 310 is moved back and forth inside the first chamber 101, it needs to overcome a frictional resistance between the head 431 of the screw and the inner surface 102. When the driving handle 420 is pushed, the fixed part 410 is moved axially in the slot 110, driving the first locking part 310 to move axially in the first chamber 101. A movement range of the fixed part 410 is limited by a length of the slot 110.

In an embodiment, symmetrical slots 110 and 110' are arranged on two sides of the first chamber 101 for easy processing. The driving part 400 can be mounted in the slot 110 or the slot 110' at will. During mounting, there is no need to distinguish between front and back sides of the quick release buckle, making it easy to mount and disassemble.

The components such as the first connecting member 100, the second connecting member 200, the first locking part 310, and the second locking part 320 each can be provided with an axisymmetric shape, such that the assembly and locking process do not need to distinguish between the front and back sides, thereby improving efficiency.

An outer side of the first connecting member 100 is provided with first connecting position 103, and an outer side of the second connecting member 200 is provided with a second connecting position 203. The first connecting position 103 and the second connecting position 203 are configured to connect clothing or an accessory that needs to be closed, such as a combat vest, a back strap, a connection strap, or a bag strap.

The second connecting member 200 is provided with the second chamber 201. The locking member 300 is provided with the second locking part 320 connected to the first locking part 310. The second chamber 201 is axially provided with an opening. The second locking part 320 is provided with bump 321. The bump 321 is inserted into the second chamber 201 through the opening in a direction perpendicular to an axial direction. In an embodiment, the opening includes wider first opening 202 and narrower second opening 204 that are communicated with each other. Correspondingly, a thickness of the bump 321 is slightly less than a thickness of the first opening 202, and a width of the bump 321 is slightly less than a width of the first opening 202. In this way, when the second locking part 320 and the second connecting member 200 are close to each other from a separated state, the bump 321 enters the second chamber 201 from the first opening 202. After entering the second chamber 201, the bump 321 is moved axially until the bump 321 is moved to the second opening 204. A width and/or thickness of the second opening 204 is less than a width and/or thickness of the bump 321. Thus, the bump 321 cannot be detached from the second chamber 201 through the second opening 204. A main body of the second locking part 320 (excluding the bump 321) has an even thickness less than the thickness of the second opening 204. Therefore, through the reasonable distribution of the bump 321 with the first opening 202 and the second opening 204, the main body of the second locking part 320 and the bump 321 can simultaneously enter the second chamber 201 from the opening. After they move axially for a certain distance in the second chamber 201, the bump 321 is blocked by edge 210 of the second opening 204, and cannot be detached from the second chamber 201. In this way, the second locking part 320 is locked with the second connecting member 200.

In other embodiments, the bump 321 has a shape matched with a shape of the first opening 202, and has a size slightly less than a size of the first opening 202, allowing the bump 321 to freely enter and exit the first opening 202. Further, the shape of the bump 321 is different from a shape of the second opening 204, and at least a part of the width or thickness of the bump is greater than the width or thickness at a corresponding part of the second opening 204, making it impossible for the bump 321 to enter and exit from the second opening 204. The shapes of the bump 321 and the first opening 202 are not limited to a rectangular solid/rectangle shown in the drawings of this specification, but can be any one that meets the above conditions. For example, the bump 321 is a sphere or hemisphere, the first opening 202 is a circular opening with a diameter slightly more than a spherical diameter of the bump 321, and the second opening 204 is still a long opening with a width less than the diameter (thickness) of the bump 321. In another embodiment, the thickness of the main body does not need to be even, as long as it can meet the following condition. That is, the main body and the bump 321 can simultaneously enter the second chamber 201, and after they are moved axially for a certain distance, the bump 321 cannot be detached from the opening of the second chamber 201.

In an embodiment, one end of the second locking part 320 is provided with extension part 330. The extension part 330 is a structure for a user to unlock by pulling. For example, in an embodiment, the extension part 330 is a flange sufficient for the user to grip and pull with a finger. In another embodiment, one end of the second locking part 320 is provided with a structure, such as mounting hole 331, through which a pull rope, a pull rod, a pull ring or a push rod easy for the user to pull or push can be provided. The mounting hole 331 can be hidden inside the first chamber 101 or extended from one end of the first chamber 101. When the mounting hole 331 extends from the one end of the first chamber 101, it can be located on the extension part 330.

To prevent the locking member 300 from being detached axially from the first chamber 101, the first connecting member 100 is provided with blocking part 140. In an embodiment, the blocking part 140 is located at a tail end of the first chamber 105.

In order to ensure that the first locking part 310 is in a locked state and remains stable in the axial direction of the first chamber 101 inside the first connecting member 100, the first locking part 310 is connected to the first connecting member 100 through a reset mechanism. In an embodiment, the first locking part 310 is provided with axially extending track 303. The reset mechanism is compression spring 500 located in the track 303. The compression spring includes first end 510 abutted against an end surface of the track 303 and second end 520 abutted against an inner part of the first connecting member 100. In an embodiment, the second end 520 of the compression spring is abutted against an inner surface of the blocking part 140. The compression spring 500 remains compressed at least throughout an unlocking process, such that the first locking part 310 has a tendency to remain inside the first chamber 101 at all times. In another embodiment, the reset mechanism can also be a tension spring (not shown in the figure) connected to the first locking part 310 and the first connecting member 100. The tension spring remains in an extended state at least throughout the unlocking process, such that the first locking part 310 always has a tendency to move into the first chamber 101. When the tension spring is provided close to second step 121, in the locked state, the driving part 400 is close to the tail end 112 of the slot. When the tension spring is provided close to first step 120, in the locked state, the driving part 400 is close to the head end 111 of the slot.

In an embodiment, the first locking part 310 enters the first chamber 101 from head end 104 of the first chamber and remains inside the first chamber 101. Tail end 105 of the first chamber is closed to prevent the locking member 300 from extending from the tail end 105 of the first chamber. In another embodiment, the first locking part 310 can enter from either the head end 104 or the tail end 105 of the first chamber, and partially extend out of the first chamber 101 from either the head end or the tail end of the first chamber. An extended part of the first locking part is moved for a distance denoted as L. Due to the distance, the bump 321 of the second locking part 320 is moved exactly from the second opening 204 to any first opening 202 adjacent to the second opening 204. When the extended part moved from the locked state finishes the distance L, the second locking part 320 can be detached from the first opening 202 and the second opening 204, thereby completing unlocking. Specifically, the bump 321 is detached from the first opening 202, and the main body of the second locking part 320 is detached from the second opening 204. The quantity of the first opening 202 and the second opening 204 is set according to requirements in terms of processing technology, material used, and axial length of the quick release buckle, etc. In an embodiment, multiple first openings 202 and second openings 204 are sequentially spaced. For example, they can be arranged in the order of number-one first opening 202, number-two second opening 204, number-two first opening 202, and number-two second opening 204.

In other embodiments, the first locking part 310 can also enter the first chamber 101 in a direction perpendicular to the axial direction. However, the first locking part 310 and the first chamber 101 only require relative movement along the axial direction and do not wish to have any relative movement in a direction perpendicular to the axial direction. Therefore, if the first locking part 310 enters the first chamber 101 in a direction perpendicular to the axial direction, it may affect the overall stability of the quick release buckle and may form a poor embodiment.

In the present disclosure, the first locking part 310 is configured to connect the first connecting member 100 and drive the second locking part 320 connected to the first locking part to move inside the second chamber 201 so as to achieve unlocking or locking. Therefore, the connection mode between the first locking part 310 and the first connecting member 100 is not limited to the connection mode mentioned in the above embodiment. In an embodiment, the first locking part 310 is fixedly connected to the second locking part 320, thereby causing the first locking part 310 and the second locking part 320 to move synchronously under the drive of the driving part 400. In another embodiment, the first locking part 310 is provided with a fixed area and a movable area (not shown in the figure). The fixed area is fixedly or detachably connected to the first connecting member 100. The movable area is fixedly connected to the second locking part 320, the fixed area, and the driving part 400. In this way, when the second locking part 320 needs to be driven to unlock, it is not necessary to move the first locking part 310 as a whole, but only to drive the movable area of the first locking part 310. The first locking part 310 does not necessarily run through the first connecting member 100. That is, the first chamber 101 does not need to run through the first connecting member 100, as long as the movable area of the first locking part 310 can be moved inside the first chamber 101 for minimum distance L for unlocking. In other words, a length of the first chamber 101 is not less than the minimum distance L for unlocking. For example, when the tension spring is used as the reset mechanism, the head end 104 of the first chamber 101 can be closed and connected to the first locking part 310 through the tension spring. In the embodiment where the first chamber 101 runs through the first connecting member 100, the bump 321 and the corresponding opening can be evenly distributed, making the entire quick release buckle stressed more evenly.

Figure 5:
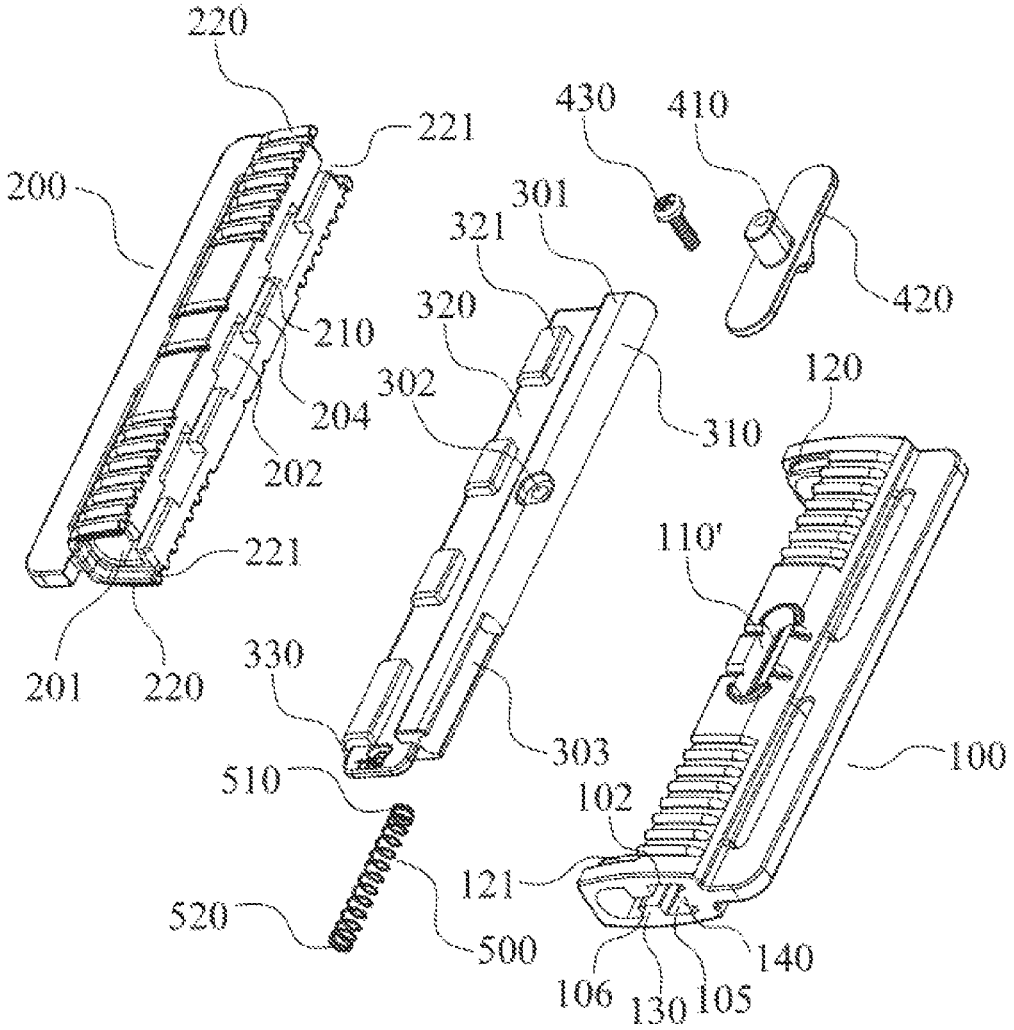
FIG. 5 is an exploded view of the quick release buckle according to the present disclosure.
Figure 6:
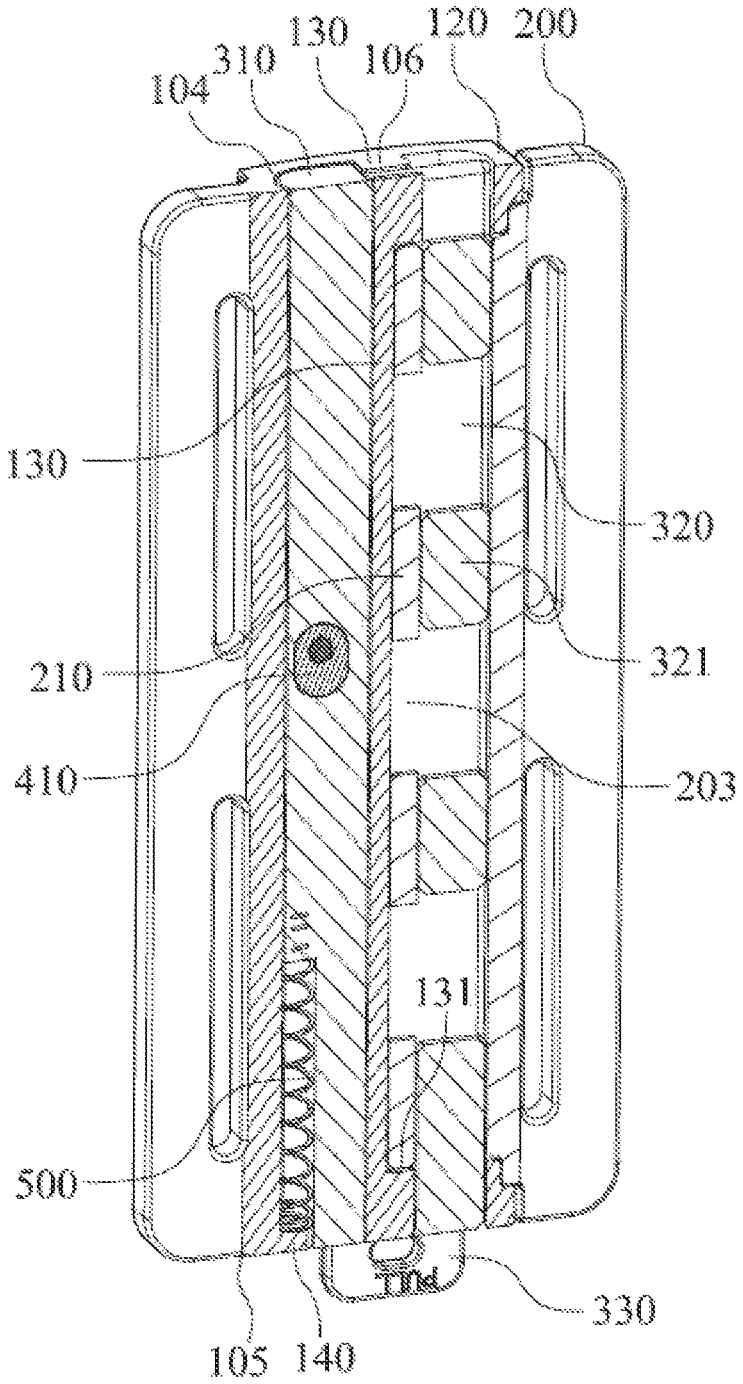
FIG. 6 is a section view taken along line C-C' shown 3.

As shown in FIGS. 5 and 6, in order to stabilize the first locking part 310 in a direction perpendicular to the axial direction, in an embodiment, a side of the first chamber 101 is provided with gap 106. The first locking part 310 is fixedly connected to the second locking part 320. The gap 106 allows the main body of the second locking part 320 to pass through, but does not allow the first locking part 310 to pass through, nor does it allow the bump 321 to pass through. In an embodiment, the gap 106 is encircled by two symmetrical protruding edges 130 extending axially on the first connecting member 100. That is, the gap 106 is formed between the two symmetrical protruding edges 130. In another embodiment, a width of the gap 106 in the axial direction is even. In other embodiments, the width of the gap 106 in an extension direction may also be uneven, but it still does not allow the first locking part 310 or the bump 321 to pass through.

In an embodiment, two ends of the second connecting member 200 are provided with axial limit structures, which are matched with two ends of the first connecting member 100 to prevent accidental unlocking due to relative axial movement between the second connecting member 200 and the first connecting member 100. For example, the two ends of the first connecting member 100 are provided with steps, including the first step 120 and the second step 121. Ends 220 of the second connecting member are provided with notches 221. The steps have a shape that is matched with a shape of the notches 221. When the locking member 300 locks the first connecting member 100 with the second connecting member 200, the steps and the notches 221 are matched with each other and remain relatively stable. On this basis, the two steps located at the two ends of the first connecting member 100 form a semi-wrapped state on the ends 220 of the second connecting member, preventing the second connecting member 200 from being detached axially from the first connecting member 100, further ensuring the uniqueness of the unlocking direction. In another embodiment, the steps are located at the two ends of the second connecting member 200, while the notches are located at the two ends of the first connecting member 100. In other embodiments, the axial limit structure between the second connecting member 200 and the first connecting member 100 can also be located at positions other than the two ends. In the locked state, the driving part 400 and the slot 110 are matched with each other to partially achieve the function of the axial limit structure. However, under the action of the reset mechanism, if no limit structure is provided, there may still be a certain distance of relative movement between the second connecting member 200 and the first connecting member 100, causing axial misalignment between the second connecting member 200 and the first connecting member 100.

An assembly process of the present disclosure is as follows. For example, if the compression spring 500 serves as the reset mechanism, first, the compression spring 500 is put into the track 303. Then, the first locking part 310 of the locking member 300 enters the first chamber 101 along the extension direction of the first chamber 101 from the head end 104 or the tail end 105 of the first chamber 101. The first end 510 of the compression spring is abutted against the end surface of the track 303, and the second end 520 of the compression spring is abutted against the inner surface of the blocking part 140. The compression spring 500 remains compressed at all times. The hole 302 of the first locking part 310 is exposed from the slot 110, and the driving part 400 is fixedly mounted into the hole 302. The first locking part 310 is released, and the fixed part 410 is obstructed by a side wall of the head end 111 of the slot. The first locking part 310 will not be detached from the first chamber 101. Without an external force, the driving part 400 is located at the head end 111 of the slot.

When it is necessary to lock the quick release buckle, the driving part 400 is pushed from the head end 111 of the slot to the tail end 112 of the slot for distance L, until the second locking part 320 is inserted into the second chamber 201 from the opening in a direction perpendicular to the axial direction. Meanwhile, the two notches 221 at the ends of the second connecting member 220 are respectively stuck by the first step 120 and the second step 121. The driving part 400 is loosened. The second locking part 320 is moved axially for distance L under the action of the compression spring 500, such that the bump 321 is blocked by the edge 210 of the second opening 204 in the direction perpendicular to the axial direction, and cannot be detached from the second chamber 201. The driving part 400 returns to the head end 111 of the slot.

When it is necessary to unlock the quick release buckle, the driving part 400 is pushed from the head end 111 of the slot to the tail end 112 of the slot for distance L, until the second locking part 320 is moved out of the second chamber 201 from the opening in a direction perpendicular to the extension direction of the second chamber 201. Meanwhile, the two notches 221 are detached from the first step 120 and the second step 121, respectively. The driving part 400 is loosened, and returns to the head end 111 of the slot.

When the user drives the locking member 300 with the driving handle 420, the driving part 400 and the slot 110 are matched with each other form an unlocking drive mechanism and unlocking limit mechanism. When the user drives the locking member 300 without using the driving handle 420, the slot 110, the fixed part 410, and the positioning part 430 are matched with each other to form only an unlocking limit mechanism. For example, when the driving handle 420 is accidentally lost or damaged, the locking member 300 can be driven through the extension part 330, the pull rod, the push rod or other structure matched with the mounting hole 331. In this case, an additional unlocking limit mechanism is needed to prevent the locking member 300 from being fully pulled out or pushed out. For example, a limit mechanism, such as one defined by a protruding part and a recessed part that are matched with each other for a clamping purpose, can be provided between the locking member 300 and the first connecting member 100. When the driving part 400, the extension part 330, and the mounting hole 331 coexist, they can provide the user with multiple driving methods for unlocking.

What is claimed is:

1. A quick release buckle, comprising a first connecting member, a second connecting member, and a locking member, wherein the first connecting member is provided with a first chamber, and the second connecting member is provided with a second chamber;

the locking member is provided with a first locking part and a second locking part connected to each other;

the first locking part is located inside the first chamber, and is connected to the first connecting member through a reset mechanism;

the second locking part is detachably connected to the second chamber;

the second locking part is provided with a bump;

the second chamber is provided with a first opening and a second opening, wherein the first opening and the second opening are located in an axial direction and are communicated with each other; and the bump enters the second chamber through the first opening in a direction perpendicular to the axial direction, and is unable to be detached from the second chamber through the second opening.

2. The quick release buckle according to claim 1, wherein the first opening and the second opening are spaced in sequence.

3. The quick release buckle according to claim 1, wherein the second locking part is provided with a main body fixedly connected to the bump; the main body of the second locking part enters the second chamber in the direction perpendicular to the axial direction, and is movable, together with the bump, inside the second chamber in the axial direction.

4. The quick release buckle according to claim 3, wherein the main body of the second locking part is fixedly connected to the first locking part.

5. The quick release buckle according to claim 3, wherein a side of the first chamber is provided with a gap; and the gap allows the main body of the second locking part to pass through, but does not allow the first locking part to pass through.

6. The quick release buckle according to claim 1, wherein one end of the second locking part is provided with a mechanism for unlocking by pulling or pushing by a user.

7. The quick release buckle according to claim 6, wherein an unlocking limit mechanism is provided between the locking member and the first connecting member.

8. The quick release buckle according to claim 1, wherein the first locking part is provided with a track axially extended; and the reset mechanism is axially connected to the track and the first connecting member.

9. The quick release buckle according to claim 8, wherein the reset mechanism is a compression spring; the compression spring comprises a first end abutted against one end of the track and a second end abutted against an inner part of the first connecting member; and the compression spring remains compressed throughout an unlocking process.

10. The quick release buckle according to claim 1, wherein the second connecting member and the first connecting member are connected to each other in a matched manner through an axial limit structure.

11. The quick release buckle according to claim 10, wherein the axial limit structure is located at two ends of each of the second connecting member and the first connecting member.

12. The quick release buckle according to claim 11, wherein the axial limit structure comprises a step and a notch, wherein the step and the notch are coincident in shape.

13. A quick release buckle, comprising a first connecting member, a second connecting member, and a locking member, wherein the first connecting member is provided with a first chamber, and the second connecting member is provided with a second chamber;

the locking member is provided with a first locking part and a second locking part connected to each other;

the first locking part is located inside the first chamber, and is connected to the first connecting member through a reset mechanism;

the second locking part is detachably connected to the second chamber;

the first connecting member is provided with slots;

the slots are communicated with the first chamber, and are axially extended;

a driving part is connected to the first locking part through the slots; and the slots define a movement range of the driving part.

14. The quick release buckle according to claim 13, wherein the driving part comprises a fixed part, a driving handle connected to the fixed part, and a positioning part fixing the fixed part to the first locking part.

15. The quick release buckle according to claim 14, wherein the first locking part is provided with a hole running through the first locking part; and the positioning part, at a first end of the hole, fixes the fixed part to a second end of the hole.

16. The quick release buckle according to claim 15, wherein the first locking part is provided with a first surface; the first chamber is provided with an inner surface; the first surface and the inner surface define a narrow gap; and a highest point of a head of the positioning part is located within the narrow gap.

17. The quick release buckle according to claim 13, wherein there are two slots symmetrically arranged at two sides of the first connecting member; and a hole communicates the two slots.

18. The quick release buckle according to claim 13, wherein the first locking part is provided with a fixed area and a movable area movably connected to each other; the fixed area is fixedly or detachably connected to the first connecting member; and the movable area is fixedly connected to the second locking part and the driving part.

* * * * *